United States Patent [19]

Snee

[11] Patent Number: 4,703,303

[45] Date of Patent: Oct. 27, 1987

[54] SOLID STATE RAILROAD LIGHTS/GATE CONTROLLER

[75] Inventor: Ronald W. Snee, Wilmington, Del.

[73] Assignee: Safetran Systems Corporation, Louisville, Ky.

[21] Appl. No.: 848,761

[22] Filed: Apr. 7, 1986

[51] Int. Cl.[4] ..... B61L 15/00

[52] U.S. Cl. ..... 340/47; 340/48; 340/49; 246/125; 246/292

[58] Field of Search ..... 340/47–50; 246/125, 127, 260, 261, 270, 292–295; 49/140

[56] References Cited

U.S. PATENT DOCUMENTS

| | | | |
|---|---|---|---|
| 3,927,852 | 12/1975 | Sibley | 246/125 |
| 3,963,202 | 6/1976 | Hopkins | 340/47 |
| 4,108,405 | 8/1978 | Gibson | 340/47 |

FOREIGN PATENT DOCUMENTS

| | | | |
|---|---|---|---|
| 2252942 | 6/1975 | France | 246/127 |

*Primary Examiner*—Donnie L. Crosland
*Attorney, Agent, or Firm*—Kinzer, Plyer, Dorn, McEachran & Jambor

[57] ABSTRACT

A railroad crossing lights/gate controller for effecting operation of the crossing lights and lowering of the crossing gate during normal train operating conditions and during a gate controller failure mode includes a train sensing input, a gate control circuit, a lights control circuit, a solid state logic and monitor circuit and a fail/safe relay. The train sensing input provides one signal condition when the approach of a train is sensed and another signal condition when no train is sensed. This input is connected to the solid state logic and monitor circuit which is also connected to the gate control circuit and the lights control circuit. The gate control circuit has power applied thereto to maintain the gate in a raised position when the train sensing input indicates a no train condition and the lights control circuit has power supplied thereto to operate the lights in a flashing condition when the train sensing input indicates the approach of a train. The logic and monitor circuit applies and removes power to the gate and lights control circuit in accordance with the signals at the input. The fail/safe relay is connected to the logic and monitor circuit and to the gate and lights control circuits to automatically remove power to the gate control circuit and apply power to operate the lights in the event no power is applied thereto. The logic and monitor circuit further senses the application of power to the gate control circuit and to the lights control circuit and removes power to the fail/safe relay under certain sensed conditions.

4 Claims, 1 Drawing Figure

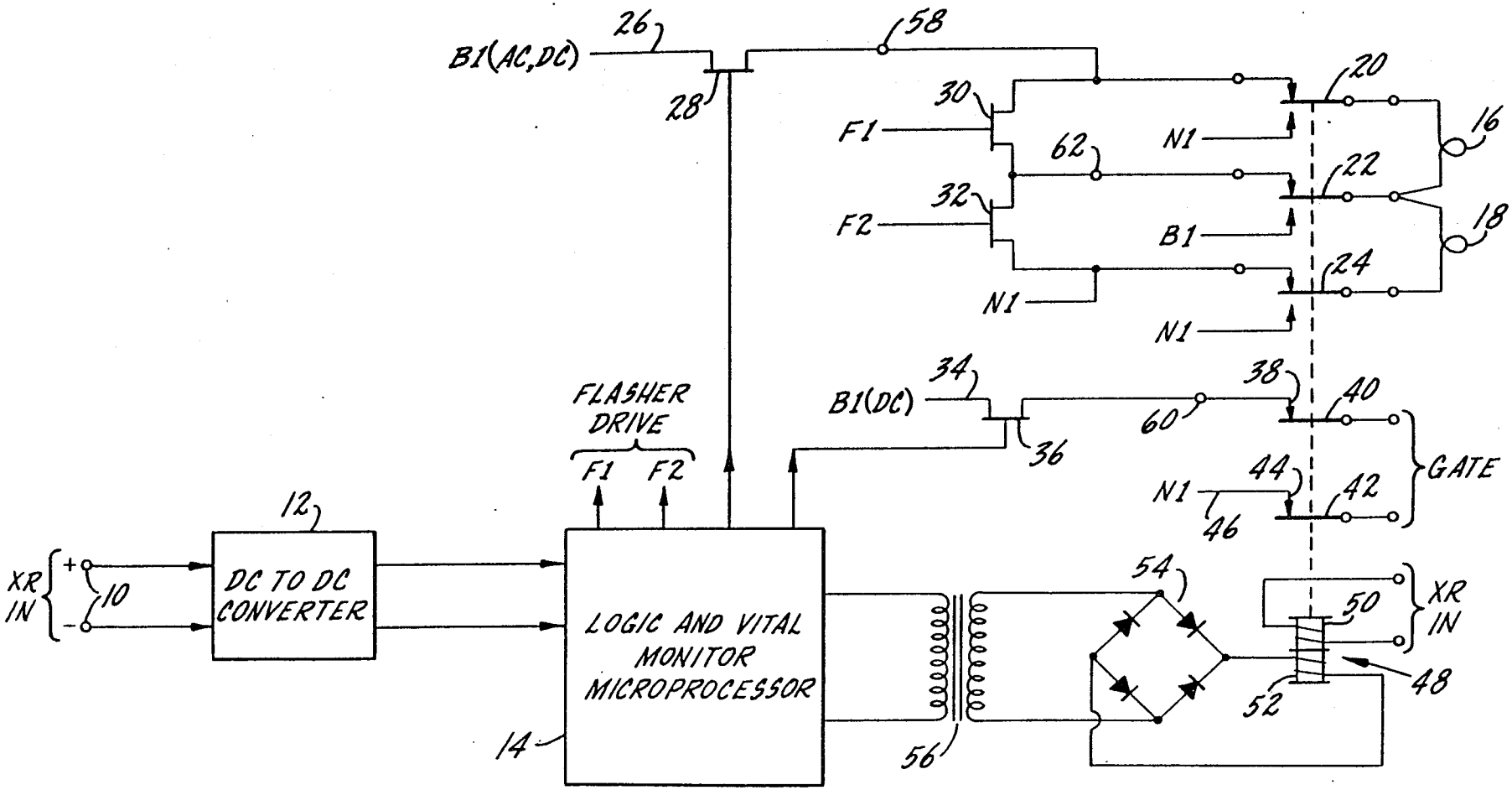
16
18
20
22
24
N1
B1
N1
62
30
32
N1
F1
F2
58
26
28
B1(AC,DC)
GATE
40
42
38
44
60
N1
46
36
34
B1(DC)
XR IN
48
50
52
54
56
LOGIC AND VITAL MONITOR MICROPROCESSOR
FLASHER DRIVE
F1
F2
14
12
DC TO DC CONVERTER
10
+
-
XR IN

SOLID STATE RAILROAD LIGHTS/GATE CONTROLLER

SUMMARY OF THE INVENTION

The present invention relates to controllers for railroad grade crossings and in particular to a controller for effecting operation of the crossing lights and lowering of the crossing gates, both during normal train operating conditions and during a controller failure mode.

A primary purpose of the present invention is a crossing lights/gate controller which has solid state logic and utilizes a fail/safe or vital relay to insure that under any abnormal condition the gates will come down and the lights will be powered.

Another purpose is a grade crossing controller of the type described which is simple in construction and reliably operable.

Another purpose is a crossing lights/gate controller which includes a fail/safe or vital relay which responds both to the solid state logic circuit and to a loss of power or other abnormal condition to insure that the gate will be lowered and the lights will be powered.

Other purposes will appear in the ensuing specification, drawing and claims.

BRIEF DESCRIPTION OF THE DRAWING

The invention is illustrated in the following block diagram of the control circuit described herein.

DESCRIPTION OF THE PREFERRED EMBODIMENT

In the railroad industry safety is a paramount concern and in such areas as railroad signal systems and railroad air brakes, whenever there is what appears to be a failure, the train brakes are operated or the signal system goes dark, which is an indication to a train crew of a red or danger condition. Thus, what can be perceived as a system failure has the effect of shutting down train operations.

The situation is somewhat different at a railroad grade crossing, as in that situation when there is what can be perceived as a failure mode, the crossing equipment must be operated. The gate must come down and the signal lights must be illuminated. Accordingly, it is necessary to provide a means to automatically insure that any type of abnormal condition will effectively cause the lights and the gate to function in a manner so as to warn a person using the grade crossing.

In the railroad industry certain components have the term "vital" applied thereto when such components are required to never be able to fail, or always to operate in a predetermined manner in the event of a failure of some other part of the system. In the present invention, a relay has been termed a vital relay in that whenever certain conditions are brought about in the grade crossing control, this relay will have its contacts always move to a certain predetermined position, which position is effective to cause operation of the gate and illumination of the signal lights. Such a vital relay is combined in the present invention with solid state logic which insures operation of the grade crossing equipment in the normal manner and also insures that the vital relay will function in the appropriate manner in an emergency situation.

In the drawing, an input is indicated at 10 and will be the input signal from the motion sensing circuit which is used at grade crossings to detect the presence of an approaching train and thereby cause operation of the gates and lights. U.S. Pat. No. 3,944,173, assigned to the assignee of the present application, illustrates a railroad crossing motion detector of the type which may be used to provide an input at terminals 10. Terminals 10 are connected to a DC-to-DC converter 12 which converts the voltage level at terminals 10 to a level more appropriate for the logic circuit to be described. The normal input to terminals 10 will be a signal at a predetermined voltage level when there is no train approaching or present. When a train has been sensed, the customary output from a motion detector is no input at terminals 10 and the lack of a signal is known to indicate that the crossing apparatus should be operated.

A logic and vital monitor microprocessor is indicated at 14 and is connected to converter 12 and thus receives an input of the signal indicating the presence or absence of a train at the crossing. Logic circuit 14 will have programmed firmware to perform the functions described below.

Warning lights are indicated at 16 and 18, with these lights representing the plurality of lights which are normally present at every grade crossing. Light 16 is connected to a relay contact arm 20 and a relay contact arm 22. Light 18 is connected to relay contact arm 22 and to a relay contact arm 24. Each of contact arms 20–24 are movable between upper and lower contacts, with the normal position of the relays being for the arms to be in contact with the upper contacts.

A source of either AC or DC power is applied to a terminal 26 which is connected to a switch 28, the position of which is controlled by logic circuit 14. The other side of switch 28 is connected to the upper contact for contact arm 20. Flasher drive switches 30 and 32 are connected across the three sets of relay contacts which cooperate with contact arms 20–24 to cause operation of the lights. The flashers cause the well-known flashing or periodic application of power to lights 16 and 18. The lower contact of each of the above-described pairs of contacts are connected to voltage or power sources designated N1, B1 and N1, respectively, with terminal 26 having polarity B1. If the signal lights are operated by AC power, the terminals designate the hot side of the line and ground, whereas, if DC power is being applied, the terminals will be positive and negative.

The control for flashers F1 and F2 is indicated to come from logic circuit 14 where the flasher drive outputs are indicated.

A crossing gate is normally maintained in the up or raised position by the application of power. Thus, DC power from terminal 34 is applied to a normally closed switch 36 to apply power to a contact 38 which cooperates with contact arm 40 to apply DC power to the gate drive to maintain it in an up position. Contact arm 42, also a part of the gate power supply circuit is in contact with a contact 44 connected to power supply terminal 46. Thus, there is a closed circuit from positive to negative through the described relay contacts and relay contact arms which will maintain the gate in an up position as long as switch 36 is closed.

The vital relay is indicated at 48 and may have two relay coils, an upper coil indicated at 50, having a direct connection to input 10, and a lower coil 52 connected to a bridge rectifier 54 and through a transformer 56 to logic circuit 14. Power to either of coils 50 or 52 will maintain contact arms 20, 22, 24, 40 and 42 in the position shown. Under normal operating conditions, power will be supplied to coil 52 by logic circuit 14.

Although not shown, the power supply will include both AC and DC sources and more particularly a back-up DC battery which is at every grade crossing and it utilized to provide assurance that the crossing system will operate in the event of a local power failure.

Under normal operating conditions, the gate control circuit and the lights control circuit have their relay contacts in the position shown. As long as a signal is present at input terminal 10, logic circuit 14 will maintain switch 28 in the open position and switch 36 in the closed position. Thus, power is supplied to the gate to maintain it in a raised position and no power is supplied to the warning lights. In the event a train is sensed on the section of track adjacent to the grade crossing, there will be a loss of signal at input 10, which loss of signal will cause the logic and vital monitor microprocessor to close switch 28 and open switch 36. The flasher drive will also be activated. The closing of switch 28 will apply power to illuminate the lights and the flashers will simultaneously function to provide the well known flashing light condition. The removal of power by the opening of switch 36 will cause the gate to be lowered as it is maintained in a raised position by the application of power.

There are three circuit condition sensors which are monitored by logic circuit 14. Sensor 58 monitors the application of power to the lights. Sensor 60 monitors the application of power to the gate circuit and sensor 62 monitors the rate at which the flashers function. At such time as there is a loss of signal at terminals 10, the gate and lights will function in the manner described, providing that each of sensors 58, 60 and 62 indicate that power is applied to the lights, power is not applied to the gate, and the flashers are functioning in a normal manner. In the event that any one of the three described sensors gives an indication which is not appropriate for a train present input signal to the logic circuit from terminals 10, the logic circuit will remove power from transformer 56 and thus from coil 52 of vital relay 48. Since there is no power to coil 50, contact arms 20, 22, 24, 40 and 42 will each move to a position opposite that shown in the drawing. Automatically, when any malfunction is detected by any any one of the three sensors, the vital relay will operate. Similarly, if there is a loss of power in the logic circuit, the vital relay will function, assuming no signal at input 10, which will cause all of the contact arms controlled by coils 50 and 52 to move to a a position opposite that shown in the drawings. The vital relay is either so mechanically positioned or the contact arms have spring control such that in the event of a loss of power to coils 50 and 52, the contact arms automatically will move away from the position shown.

When contact arms 20, 22 and 24 all move to a down position, lights 16 and 18 will be connected directly to the power supply represented by terminals N1 and B1. The lights will be illuminated, although they will not be flashed, as the flashers are not in the circuit when the contact arms are in the down position. Thus, there will be continuous illumination of the lights at the grade crossing.

In like manner, when contact arms 40 and 42 move away from contacts 38 and 44, respectively, power is removed from the gate circuit which causes the gate to be lowered.

The direct connection between input 10 and coil 50 of vital relay 48 provides a reliability enhancement to insure that the vital relay is responsive to a signal at the input and is not misled by a loss of power from the vital relay. The vital relay is used to turn on the lights and to lower the gate when something is wrong in the system, regardless of what it may be. There may be a power failure, or there may be a failure in the logic circuit or there may be some other type of malfunction. When something does go wrong, because of the nature of the relay, the gate is lowered and the lights are turned on.

Whereas the preferred form of the invention has been shown and described herein, it should be realized that there may be many modifications, substitutions and alterations thereto.

The embodiments of the invention in which an exclusive property or privilege is claimed are defined as follows:

1. A crossing lights/gate controller for effecting operation of the crossing lights and lowering of the crossing gate during normal train operating conditions and during a controller failure mode including, a train sensing input providing one signal condition when the approach of a train is sensed and another signal condition when no train is sensed, a gate control circuit which has power supplied thereto to maintain the gate in a raised position when the train sensing input indicates a no train condition, a lights control circuit which has power supplied thereto to operate the lights in a flashing condition when the train sensing input indicates the approach of a train, a solid state logic and monitor circuit connected to said input, gate control circuit, and lights control circuit, said logic and monitor circuit applying and removing power to said gate and lights control circuits in accordance with the signals at said input, a fail/safe relay connected to said logic and monitor circuit and said gate and lights control circuits, which relay automatically removes power to said gate control circuit and applies power to operate the lights in the event no power is applied thereto, and a direct connection between said input and said fail/safe relay to insure that said relay is responsive to a signal at said input.

2. The controller of claim 1 further characterized in that said lights control circuit and gate control circuit each include relays whose contacts have a normal position in which power is supplied to maintain the gate in a raised position and power is supplied to operate the lights in a flashing condition, which relay contacts will move to a contrary position upon the loss of power at said fail/safe relay.

3. A crossing lights/gate controller for effecting operation of the crossing lights and lowering of the crossing gate during normal train operating conditions and during a controller failure mode including, a train sensing input providing one signal condition when the approach of a train is sensed and another signal condition when no train is sensed, a gate control circuit which has power supplied thereto to maintain the gate in a raised position when the train sensing input indicates a no train condition, a lights control circuit which has power supplied thereto to operate the lights in a flashing condition when the train sensing input indicates the approach of a train, a solid state logic and monitor circuit connected to said input, gate control circuit, and lights control circuit, said logic and monitor circuit applying and removing power to said gate and lights control circuits in accordance with the signals at said input, a fail/safe relay connected to said logic and monitor circuit and said gate and lights control circuits, which relay automatically removes power to said gate control circuit and applies power to operate the lights in the event no power is applied thereto, said logic and monitor circuit monitoring the application of power to said gate control circuit and said lights control circuit, said fail/safe relay automatically removing power to said gate control circuit and applying power to operate the lights in the event the logic and monitor circuit has a train sensed input and senses either power to the gate control circuit or no power to the lights control circuit.

4. The controller of claim 3 further characterized in that said logic and monitor circuit also monitors the rate at which said lights flash, with the flashing rate, along with the sensed conditions of power to the gate control circuit or no power to the lights control circuit, being one of the conditions which is effective to remove power to said fail/safe relay.

* * * * *